United States Patent [19]

Rohner

[11] 4,213,582

[45] Jul. 22, 1980

[54] WINDING DEVICE

[75] Inventor: Peter Rohner, Eschenkamp, Fed. Rep. of Germany

[73] Assignee: Kabel-und Metallwerke Gutehoffnungshuette AG, Fed. Rep. of Germany

[21] Appl. No.: 961,364

[22] Filed: Nov. 16, 1978

[30] Foreign Application Priority Data

Nov. 22, 1977 [DE] Fed. Rep. of Germany ..... 2751989

[51] Int. Cl.[2] ..... B65H 75/22; B65H 75/26

[52] U.S. Cl. ..... 242/110; 242/2; 242/47; 242/54 R; 242/127

[58] Field of Search ..... 242/110, 110.1, 110.2, 242/110.3, 47, 2, 115, 127, 54 R

[56] References Cited

U.S. PATENT DOCUMENTS

| | | | |
|---|---|---|---|
| 1,658,799 | 2/1928 | De Vogel | 242/110 X |
| 2,206,627 | 7/1940 | Borkey | 242/110.1 X |
| 4,124,171 | 11/1978 | Lucke | 242/2 |

FOREIGN PATENT DOCUMENTS

| | | | |
|---|---|---|---|
| 114680 | 4/1926 | Switzerland | 242/110.1 |
| 456776 | 2/1975 | U.S.S.R. | 242/110.1 |

*Primary Examiner*—George F. Mautz

*Attorney, Agent, or Firm*—James C. Jangarathis

[57] ABSTRACT

A winding device comprised of parallel spaced supporting bodies on which an elongated flexible material is helically wound in a single layer. The bodies are interconnected by a folding mechanism, whereby the bodies can be axially displaced to reduce the distance therebetween and thereby reduce the length of one axis of the wound material while retaining the length of the other axis to permit transportation thereof in appropriately sized containers.

1 Claim, 7 Drawing Figures

FIG. 1
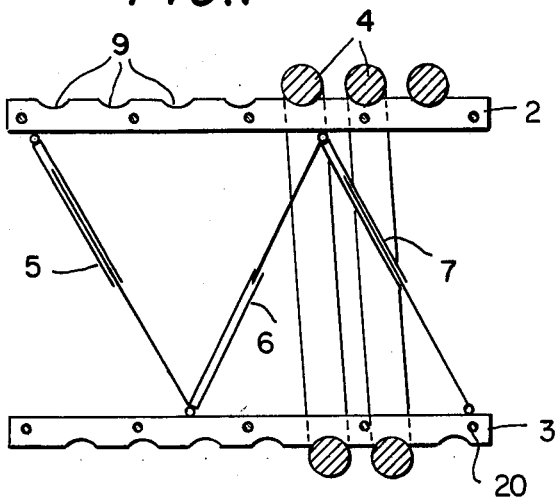
FIG. 2
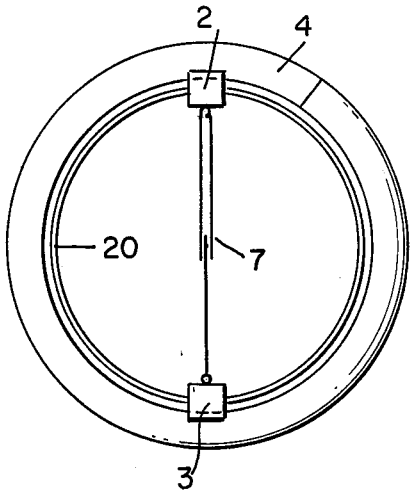
FIG. 3
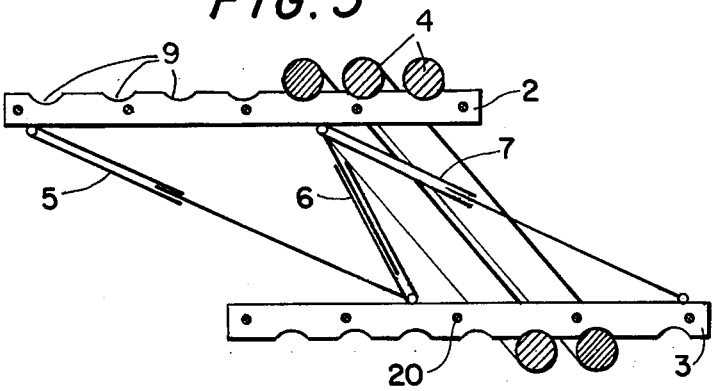
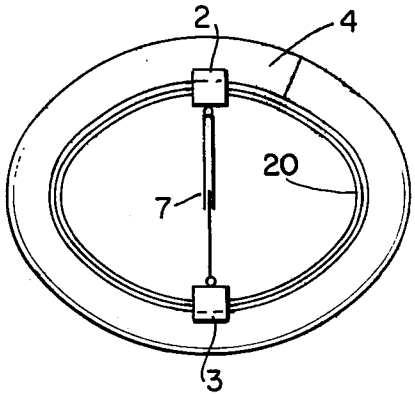
FIG. 4
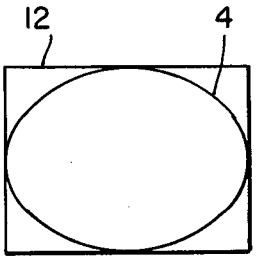
FIG. 5
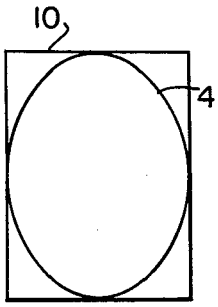
FIG. 6
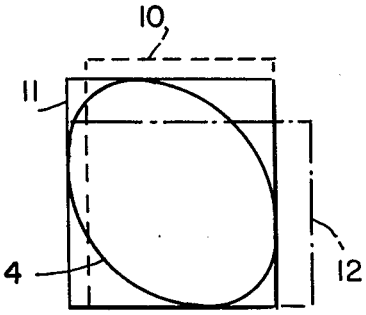
FIG. 7

WINDING DEVICE

The present invention relates to a device for winding flexible, elongated material.

"Elongated material" in the terms of the present invention are, for example, tubes or pipes, electrical cables and also cables for remote heating consisting of at least two flexible tubes insulated against each other. All such structures have in common that they are flexible and producible with nearly infinite lengths, and that they may thus be wound, for example on drums. It is the advantage of such flexible structures that relatively great lengths thereof may be readily transported and readily laid, so that relatively few connecting sleeves are needed at the site of installation. The length of such an elongated structure to be transported depends essentially on the capacity of the drum which, however, is limited with respect to its size based on transportation limitations. Since such drums may neither be too high nor too wide in order to allow their shipping by means of the usual transportation means, a certain bending radius is required for the length of material to be transported. It the elongated structure does not permit said defined bending radius, it cannot be transported wound on drums but it must be shipped in elongated condition in pieces of relatively short length. Even if transportation on drums is basically feasible based on the permissible bending radius, it may be desirable to ship in one piece in lengths larger or greater than the lengths that can be received by drums.

It is the objective of the present invention to provide a device making it possible to transport both elongated material having a permissible outer bending diameter larger than the width or height of the available transport space, and material shipped in one piece in lengths greater than those permissible for transport by means of customary drums.

In accordance with the present invention, there is provided a winding device for winding flexible elongated material which is comprised of two spaced parallel elongated supporting bodies for receiving and supporting the material as a single helically wound layer. The elongated supporting bodies are connected by a movable connecting or folding means which is movable to permit axial displacement of the supporting bodies and reduction of the distance therebetween to thereby provide the helically wound material with an axis of reduced diameter. Thus, the material can be wound to provide a tubular configuration of helical windings having a circular cross-section and by decreasing the distance between the tubular configuration of supporting bodies the helical winding is provided with an elliptical cross-section having a major axis of a length which corresponds to the diameter of the circular cross-section, and a minor axis of a length which is less than the diameter of the circular cross-section. It is also to be understood that the material can be originally wound with an elliptical cross-section with the movement of the supporting bodies reducing the length of the minor axis.

The winding device of the present invention may be employed for winding a flexible material for subsequent transportation in winding machines of the type conventionally employed for winding material onto a drum, with the winding device of the present invention corresponding to the drum. The flexible material is wound on the winding device or core of the present invention as a single layer with the turns of the material being spaced from each other by a distance which is sufficient to permit the folding action which results from the axial displacement of the supporting bodies. Upon folding, the overall cross-section of the helically wound material is changed to ellipse having one axis of a reduced diameter; however, the overall shape of each of the individual windings or turns is retained so that the deforming forces are low. Prior to effecting the folding of the wound material, any unneeded or interfering portions of the winding core are removed, if necessary.

By reducing the distance between the helically wound material along one axis thereof, the wound material may be transported, for example, in a suitably shaped container, which has either a height or a width less than that which would have been required for transporting of the material when wound on conventional devices. If the wound material is placed in the container in an inclined position, then both the height and the width of the container can be reduced. Thus, the present invention permits transportation of material, in wound form, which has a bending radius in excess of that which is usually considered as the upper limit for transportation in that such material can be wound in accordance with the bending radius, with the height or width of the wound material then being reduced by the folding mechanism in accordance with the invention, and without exerting excess deforming force on the individual turns or windings. Thus, the number of windings or length of the wound material is determined by the length of the available shipping or transport space.

The invention will be further described with respect to the accompanying drawings, wherein:

FIG. 1 is a simplified schematic view of an embodiment of the winding device of the present invention including wound material;

FIG. 2 is a simplified schematic end view of the embodiment of FIG. 1;

FIG. 3 is a simplified schematic view of the embodiment of FIG. 1 ready for transport of wound material;

FIG. 4 is a simplified schematic end view of the device of FIG. 3;

FIGS. 5,6 and 7 are schematic representations of the device containing wound material in containers.

Referring now to FIGS. 1 and 2 of the drawings, there is shown a winding device or core which is comprised of two parallel spaced supporting bodies 2 and 3 for receiving and supporting a flexible elongated material as a single helically wound layer. The material shown, by way of illustration is electrical cable 4. It is to be understood that more than two supporting bodies can be employed.

The supporting bodies 2 and 3 are interconnected to form a winding unit or coil by a plurality of coupling means, such as struts 20, attached to the supporting bodies 2 and 3. The struts 20 are attached to the supporting bodies 2 and 3 in a manner such that they do not interfere with the axial displacement of such bodies, and as particularly shown such struts 20 have an arcuate shape and in conjunction with the supporting bodies 2 and 3 form a generally cylindrically shaped winding body or core. The struts 20 have a sufficient space therebetween and are sufficiently deformable to permit axial displacement of the supporting bodies 2 and 3 as hereinafter described.

The interior of the winding body or core is provided with movable folding means, particularly shown as bars or rods 5, 6 and 7, which are connected to the supporting bodies 2 and 3 to define a folding mechanism which permits axial displacement of the supporting bodies 2 and 3 and reduction of the distance therebetween. The rods or bars 5, 6 and 7 are capable of being elongated or shortened, as appropriate, to reduce or increase the distance between the supporting bodies 2 and 3; e.g., the rods 5, 6 and 7 can be telescopic and lenthened and shortened by an appropriate spring, pneumatic or hydraulic actuation.

The outer surface of the bodies 2 and 3 include a plurality of spaced recesses 9 for receiving the wound material, with such recesses functioning to insure that there is a sufficient space between windings or turns to permit a subsequent folding of the wound material.

In operation, the distance between supporting bodies 2 and 3 is selected to correspond to the winding diameter (bending radius) of the cable 4 to be wound. The supporting bodies are locked and cable 4 is helically wound thereon in a single layer, preferably with a circular cross-section.

After winding is complete, the lock between the supporting bodies is released and the supporting bodies 2 and 3 are axially displaced, in opposite directions, resulting in a reduction in the distance between such bodies. In such axial displacement, rods 5 and 7 of the movable connecting and folding mechanism are lengthened and rod 6 is shortened. The supporting bodies are then locked whereby the device, including the wound material 4 assumes the position shown in FIGS. 3 and 4. The wound material has an elliptical cross-section, with the major axis thereof having a length which corresponds to the diameter of the wound material as originally wound, and the minor axis thereof having a length considerably less than such original diameter. The reduction in length along the minor axis is achieved at the expense of a greater total axial length for the wound material; however, the length provides no obstacle to shipping of the wound material. In transit, clamping bodies with matching recesses can be employed to clamp the wound material between the supporting and clamping bodies to additionally secure the windings.

As hereinabove indicated, it is also possible to provide more than two supporting bodies; e.g., three supporting bodies, in which case the supporting bodies would be positioned on an annular circumference. The folding mechanism in such an embodiment would have to be of a more complicated design so as to permit formation of an ellipsoidal configuration of wound material, as shown in FIG. 4; i.e., the supporting rods would have to be positioned on an ellipsoidal contour line after axial displacement thereof.

The winding core including wound material upon displacement of supporting bodies 2 and 3 in the axial direction, may either be transported in the position shown in FIG. 5, in which position the reduced dimension is with respect to the height of the core, or as shown in FIG. 6, in which said reduction is effective with respect to the width of the core to be transported, namely by placing said core in a container 10 in such a way that the large axis of the ellipse is in an upright position. According to a third embodiment, it is possible to accommodate the finished core in a respectively shaped container 11 in such a way that the large axis is inclined as shown in FIG. 7. As compared to container 10, container 11 is flatter but somewhat wider, and slightly higher but more narrow as compared to container 12 shown in FIG. 5.

The shape, in which the finished winding is to be transported, is ultimately determined by the shipping distance and also by the transportation means. In any case, the use of the device according to the present invention permits the transportation of generally elongated material in wound form with very large bending diameters or in very great lengths.

The advantages offered by the device of the present invention are additionally explained with respect to the following figures given by way of example.

The outside diameter of a cable is 380 mm, and the permissible outside bending diameter 4.45 meters. Using a conventional drum with a flange diameter 4.5 m and a width of 2.9 m, it is possible to transport about a length of 77 m of such a cable, taking into account the thickness of the flange and the drum casing. By using the device of the present invention, approximately 260 meters of such a cable can be accommodated in a container with 16 m length and the above cross-sectional dimensions, and may thus be transported in one piece. If the permissible bending diameter is larger by 30 cm, and thus 4.75 m, any transport on a drum would require special transportation measures. By using the device of the invention, 180 meters of cable could be transported in the above container.

Numerous modifications and variations of the present invention are possible in light of the above teachings, and therefore, within the scope of the appended claims the invention may be practiced otherwise than as particularly described.

I claim:

1. A device for winding thereabout flexible elongated material, comprising:

first and second elongated support bodies spacially positioned parallel with respect to each other;

a plurality of supporting struts each interconnected between said first and second supporting bodies along their respective longitudinal lengths and forming, in conjunction with said support bodies, a generally cylindrical winding core, each of said struts having an arcuate shape and being sufficiently longitudinally spaced with respect to each other to permit longitudinal displacement of said first and second support bodies in opposite directions; and a plurality of telescoping means each connected between said first and second support bodies, each of said telescoping means being capable of expansion and contraction to provide a first radial distance between said first and second support bodies when they are in substantial longitudinal alignment with respect to each other, and a second radial distance less than said first radial distance when said support bodies are longitudinally displaced from said alignment;

said first support body comprising a plurality of first discrete engaging means spaced longitudinally along its outer surface; said second support body comprising a plurality of second discrete engaging means spaced longitudinally along its outer surface; each of said first and second engaging means being adapted to receive, respectively, first and second surface portions of each of the individual turns of a flexible elongated material helically wound in a single layer about said cylindrical winding core;

whereby each of said first engaging means longitudinally displaces, and reduces the radial distance to the longitudinal axis of said winding core, of that portion of the individual turn it engages as said first support body is longitudinally displaced from substantial longitudinal alignment with respect to said second support body; and each of said second engaging means longitudinally displaces, and reduces the radial distance to the longitudinal axis of said winding core, of that portion of the individual turn it engages as said second support body is longitudinally displaced from substantial longitudinal alignment with respect to said first support body, thus causing each of said individual turns to be tilted toward the longitudinal direction of the winding core so that the overall shape of each of such individual turns is substantially retained, while the helically wound single layer formed of said plurality of tilted individual turns has an increased overall longitudinal length, and a cross-section with a radial axis of reduced length.

* * * * *